US005846446A

United States Patent [19]

Jackson

[11] Patent Number: 5,846,446

[45] Date of Patent: Dec. 8, 1998

[54] ICE MAKING BAG

[76] Inventor: George W. Jackson, 7910 Frost St., Suite 108, San Diego, Calif. 92123

[21] Appl. No.: 848,610

[22] Filed: Apr. 29, 1997

[51] Int. Cl.[6] ..... F25C 1/24

[52] U.S. Cl. ..... 249/110; 249/119; 249/129; 383/38; 383/45; 383/57

[58] Field of Search ..... 383/38, 45, 57; 249/110, 119, 126, 127, 129; 62/356

[56] References Cited

U.S. PATENT DOCUMENTS

| | | | |
|---|---|---|---|
| Re. 31,890 | 5/1985 | Vangedal | 249/61 |
| D. 274,602 | 7/1984 | Vangedal | D9/305 |
| D. 288,409 | 2/1987 | Mikkelsen | D9/305 |
| 4,181,285 | 1/1980 | Vangedal | 249/61 |
| 4,478,386 | 10/1984 | Mikkelsen | 383/38 |
| 4,587,810 | 5/1986 | Fletcher | 62/3 |
| 4,804,083 | 2/1989 | Weeks | 206/216 |
| 4,813,646 | 3/1989 | Fujio | 249/127 |
| 4,815,691 | 3/1989 | Cooley | 249/120 |
| 4,822,180 | 4/1989 | Gjelstrup et al. | 383/57 |
| 4,899,976 | 2/1990 | Cederroth | 249/61 |
| 5,527,012 | 6/1996 | Vinkel et al. | 249/61 |

FOREIGN PATENT DOCUMENTS

| | | | |
|---|---|---|---|
| 0264407B1 | 3/1991 | European Pat. Off. . | |
| WO 92/15491 | 9/1992 | WIPO | 383/38 |

*Primary Examiner*—William E. Tapolcai

[57] ABSTRACT

A first ice making bag (110) comprises a first envelope (112) which comprises a first envelope top (112T) and a first envelope bottom (112B). The first ice making bag (110) further comprises a first binding (114) which comprises a first peripheral binding (114A). A first left peripheral opening binding (114AL), and a first right peripheral opening binding (114AR). The first left peripheral opening binding (114AL) and the first right peripheral opening binding (114AR) form a gap therebetween. The first binding (114) functions to form a pocket between the first envelope top (112T) and the first envelope bottom (112B). The first ice making bag (110) further comprises at least one first opening binding (114B) forming an air channel between the first left peripheral opening binding (114AL) or the first right peripheral opening binding (114AR) and the at least one first opening binding (114B). An user holds the first ice making bag (110) in a vertical position pouring liquid in through the gap into the pocket formed between the first envelope top (112T) and a first envelope bottom (112B) and placing the first ice making bag (110) in a freezer to form first ice (118). The air channel functions to facilitate release of air previously entrapped in the pocket during filing.

14 Claims, 2 Drawing Sheets

ICE MAKING BAG

BACKGROUND OF THE INVENTION

1. Field of the Invention

The present invention relates to a freezing mold bag. More particularly, the present invention relates to freezing ice lumps or ice cubes in a bag with a unique method of venting and self sealing under pressure.

2. Description of the Prior Art

Ice cubes have been molded in trays which are filled with water an placed in a freezing compartment. A release mechanism permits the ice cubes to be removed intact for use. The two primary release means; a lever moving baffles and the flexible tray after result in the ice cubes breaking. This method has been improved upon by a mold bag with shapes molded in. The mold bag is filled with liquid and placed in a freezing compartment. Removal of the ice cubes is accomplished by tearing the mold bag to release the ice pieces. A problem with the mold bag is that air can enter during any part of the process which causes less ice to be formed and in some cases cosmetic flaws in the resulting ice cubes. The risk of air entry is especially high during the process of sealing the bag. What is desired is a mold bag which can be sealed with out permitting the entry of air. This requires a seal on the filing end of the bag it is further desirable that the sealing be automatic.

Numerous innovations for Ice Making Bag have been provided in the prior art that are described as follows. Even though these innovations may be suitable for the specific individual purposes to which they address, they differ from the present invention as hereinafter contrasted.

In U.S. Pat. No. 5,527,012, issued Jun. 18, 1996, titled Freezing mold bag, especially for freezing ice lumps, invented by Vinked; Erik K. (Abyhoej, DK); Vangedal-Nielsen; Erling (Vedbaek, DK) and applied for on Feb. 10, 1994, in class 249 sub class 6, a freezing mold bag for ices is formed from two plastic foils, and has a segmented inlet channel, two closure valve flaps extending within the interior of the bag, and a constriction which provides a venturi effect closing the bag at the constriction.

In U.S. Pat. No. 4,899,976, issued Feb. 13, 1990, titled Ice cube tray, invented by Cederroth; Sture C. (New York, N.Y.); Zutler; Bruce B. (Stamford, Conn.), applied for on Apr. 29, 1988, there is provided an ice tray and ice cubes formed therein in which the ice cubes contain embossments. The ice cube tray includes a base having a plurality of cavities. Each cavity has a bottom and a plurality of said walls and preferably the bottom has a surface in the cavity which surface has a protuberance. The ice tray also includes a cover secured to the base. Once a formed ice cube is removed from a cavity, the cavity can not be used to form a new ice cube.

In U.S. Pat. No. 4,815,691, issued Mar. 28, 1989, invented by Cooley; Richard (21000 Gist Rd., Los Gatos, Calif. 95030), titled Method and apparatus for making ice cubes, filed on Apr. 25, 1988, in class 249/120, a method and apparatus for making ice cubes is disclosed wherein a large number of ice trays or liquid trapping elements are placed in a larger container, liquid added to the larger container or a level which will fill the liquid trapping elements when the container is positioned in an ultimate storage position and in the ultimate storage position, all the liquid not trapped in the trapping elements is drained. Apparatus disclosed is a container for closely receiving a plurality of ice trays and a lid with a closeable drain opening. A closeable opening is shown in a container wall. Racks can be provided on one container wall and the container can be made of insulating material.

In U.S. Pat. No. 4,804,083, issued on Feb. 14, 1989, titled Combination water/ice cube bottle, invented by Weeks; Philip A. (84 Ellice Street, Wellington, NZ), filed on Jun. 9, 1987, in class 206/216, a container in which fresh water can be packed and from which if desired it can be poured or if frozen from which ice cubes of any particular shape can be removed. If the container is filled with uncontaminated water, uncontaminated ice cubes can be removed therefrom.

In patent number D288,409, issued Feb. 24, 1987, titled Bag for freezing liquids, invented by Mikkelsen; Henrik (Naerum, DK), filed Dec. 9, 1983, inclass 249/61, an ornamental design for a bag for freezing liquids, as shown and described.

In U.S. Pat. No. 4,587,810, issued May 13, 1986, titled Thermoelectric ice maker with plastic bag mold, invented by Inventors: Fletcher; Charles J. (Sparta, N.J.), Filed: Jul. 26, 1984, in class 62/3.63 an ice maker with a flexible wall bag supported on a planar cooling surface and having a plurality of water compartments for molding ice cubes. The planar cooling surface is in direct thermal communication with a thermoelectric refrigeration unit for freezing water contained in the ice mold bag. The cooling surface may be the bottom of a cooling tray cooperating with an insulated housing to define a freezing chamber for receiving the ice mold bag. The refrigeration unit is mounted on the bottom wall of the cooling tray. The insulated housing includes an insulated door for access into the freezing chamber and may comprise integral front, rear and side walls. The insulated housing and cooling tray are detachably supported within a cabinet for housing the refrigeration unit. The flexible walls of the ice mold bag are of a material that is easily ruptured for removal of individual ice cubes and may include additional means to facilitate wall rupture.

In patent number RE31,890, issued May 21, 1985, titled Freezing mold bag, Inventors: Vangedal-Nielsen; Erling (Kirke Vaerlosevej 67, DK-3500, Vaerlose, DK), Filed: Aug. 20, 1981, in class 249/61, a freezing mold bags are disclosed, having a plurality of mold compartments, which communicate with each other and, in turn, with a liquid inlet. The liquid inlet and the mold compartments are defined by a pattern of joints or sealings between two opposed bag sheets constituting the bag walls. The mold bags are well-suited for preparing ice pieces of the ice "cube"-type, but may also be used for other purposes. The questions raised in reexamination request No. 90/000,090, filed Oct. 15, 1981, has been considered and the results thereof are reflected in this reissue patent which constitutes the reexamination certificate required by 35 U.S.C. 307 as provided in 37 CFR 1.570(e).

In patent number D274,602, issued Jul. 10, 1984, titled Compartmented bag, invented by Vangedal-Nielsen; Erling (67 Kirke Vaerlosevej, DK-3500 Vaerlosej, DK), filed Sep. 3, 1981, in classes D9/305, an ornamental design for a compartmented bag, substantially as shown and described.

In U.S. Pat. No. 4,181,285, issued Jan. 1, 1980, titled Freezing mold bag, invented by Vangedal-Nielsen; Erling (Kirke Vaerlosevej 67, DK-3500 Vaerlose, DK, Filed: Jan. 24, 1978, Current U.S. Class: 249/61, freezing mold bags are disclosed, having a plurality of mold compartments which communicate with each other and, in turn, with a liquid inlet. The liquid inlet and the mold compartments are defined by a pattern of joints or seals between two opposed bag sheets constituting the bag walls. The mold bags are well-suited for preparing ice pieces of the ice "cube"-type, but may also be used for other purposes.

The above patented inventions differ from the present invention because they fail to describe or claim at least one combination of the following features depicted in the present invention.

Numerous innovations for ice making bag have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a vented, hydraulically self sealing ice cube bag which uses the line pressure from a water source to actuate internal flaps forming a seal. Significant advantages resulting from this approach are; more volume of ice is created because air bubbles are eliminated and the cubes are more rounded in shape.

The types of problems encountered in the prior art are filled bag contain significant trapped air which reduces the volume of ice. Further, because the ice is not under pressure the resultant ice cubes tend to have sharper edges. The prior art bags cannot be filled under pressure because when this is attempted the bags will burst.

In the prior art, unsuccessful attempts to solve this problem were attempted namely self sealing bags under static pressure which permits air to be trapped inside the bag reducing the volume of ice. However, the problem was solved by the present invention because filing is done under pressure and several vent holes are provides resulting in more volume of ice per bag and faster filling with out the risk of a pressurized overflow.

Innovations within the prior art are rapidly being exploited as unique and better methods and devices are developed to create ice cubes in various shapes.

The present invention solved a long felt need ice forming device which is self sealing, reusable, minimizes entrapped air, and rounds the ice cubes.

Accordingly, it is an object of the present invention to provide a self sealing ice cube bag.

More particularly, it is an object of the present invention to provide a self sealing ice cube bag which minimizes entrapped air.

When the ice cube bag is designed in accordance with the present invention, a easier filling bag, with rounded ice cubes results.

In keeping with these objects, and with others which will become apparent hereinafter, one feature of the present invention resides, briefly stated, in an ice making bag sealed around a peripheral edge.

In accordance with another feature of the present invention first envelope top has a first envelope top lip and a first envelope bottom lip which expand as a liquid is forced in and contract to form a seal when a liquid pushes from the opposite direction.

Another feature of the present invention is that a first binding seals the outside edge of the envelope.

Yet another feature of the present invention is that first right air channel and first left air channel provide venting as the ice making bag is filled.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

FIRST EMBODIMENT

110—first ice making bag (110)
112—first envelope (112)
112T—first envelope top (112T)
112TA—first envelope top lip (112TA)
112B—first envelope bottom (112B)
112BA—first envelope bottom lip (112BA)
114—first binding (114)
114A—first peripheral binding (114A)
114AA—first peripheral binding indent (114AA)
114AL—first left peripheral opening binding (114AL)
114AR—first right peripheral opening binding (114AR)
114B—first opening binding (114B)
114BL—first left opening binding (114BL)
114BLA—first left opening binding indent (114BLA)
114BR—first right opening binding (114BR)
114BRA—first right opening binding indent (114BRA)
114C—first central binding (114C)
114C'—first primary central binding (114C')
114C'L—first primary central left binding (114C'L)
114C'R—first primary central right binding (114C'R)
114C'T—first primary central top binding (114C'T)
114C'B—first primary central bottom binding (114C'B)
114C"—first secondary central binding (114C")
114C"L—first secondary central left binding (114C"L)
114C"R—first secondary central right binding (114C"R)
114C"T—first secondary central top binding (114C"T)
114C"B—first secondary central bottom binding (114C"B)
114D—first middle binding (114D)
116R—first right air channel (116R)
116L—first left air channel (116L)
118—first ice (118)

DESCRIPTION OF THE PREFERRED EMBODIMENT

Figure 1:
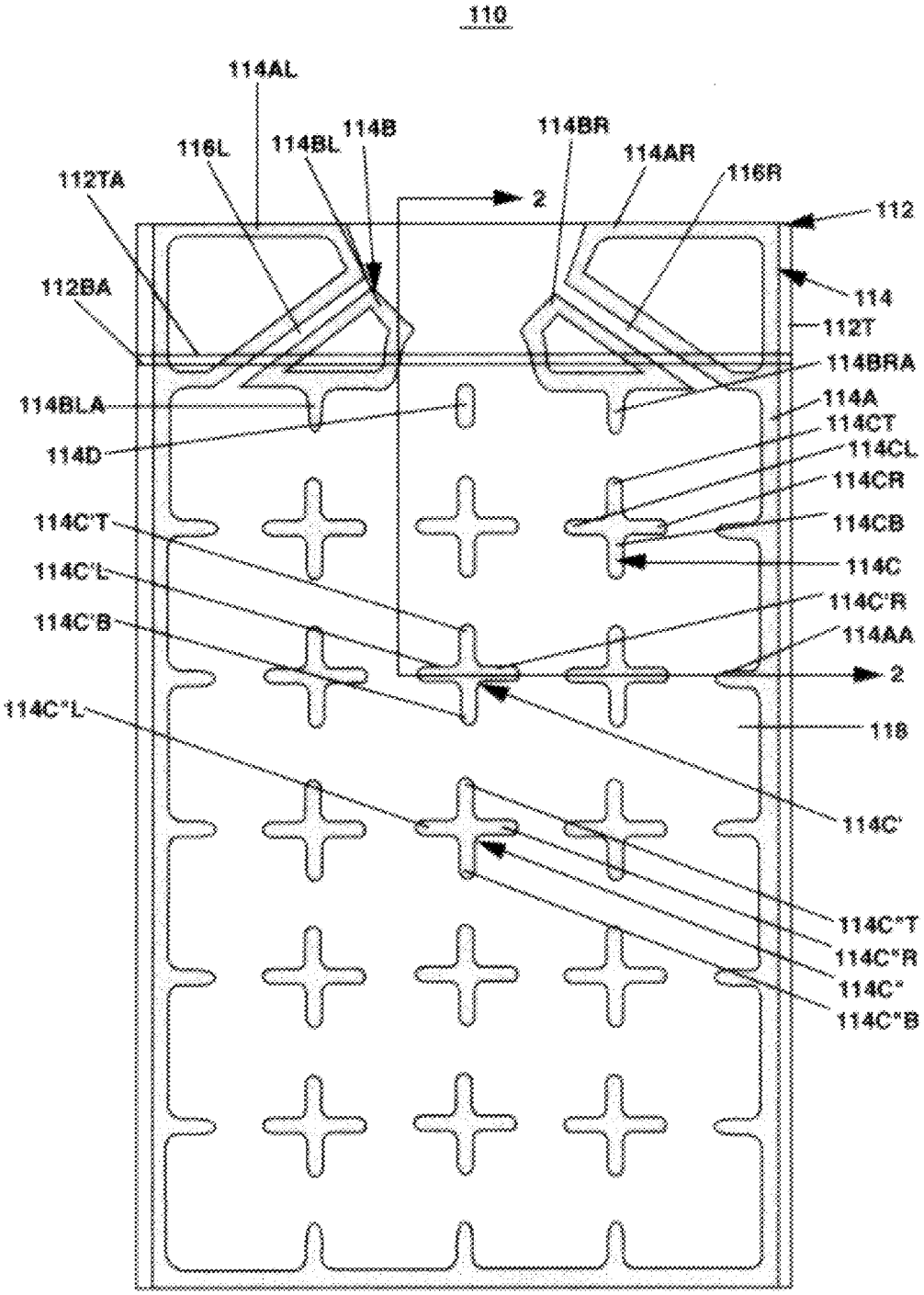
FIG. 1 is a top view of a first ice making bag (110).

Firstly, referring to FIG. 1 which is a top view of a first ice making bag (110). A first ice making bag (110) comprises a first envelope (112) which comprises a first envelope top (112T) and a first envelope bottom (112B).

The first ice making bag (110) further comprises a first binding (114) which comprises a first peripheral binding (114A), a first left peripheral opening binding (114AL), and a first right peripheral opening binding (114AR). The first left peripheral opening binding (114AL) and the first right peripheral opening binding (114AR) form a gap therebetween. The first binding (114) functions to form a pocket between the first envelope top (112T) and the first envelope bottom (112B). The first peripheral binding (114A) comprises at least one first peripheral binding indent (114AA) functioning to facilitate cracking of the first ice (118) into separate cubes.

The first ice making bag (110) further comprises at least one first opening binding (114B) forming an air channel between the first left peripheral opening binding (114AL) or the first right peripheral opening binding (114AR) and the at least one first opening binding (114B). The first opening binding (114B) comprises a first left opening binding (114BL) and a first right opening binding (114BR). The first left opening binding (114BL) and the first left peripheral opening binding (114AL) form a first left air channel (116L) therebetween. The first right opening binding (114BR) and the first right peripheral opening binding (114AR) form a first right air channel (116R) therebetween. The first left opening binding (114BL) may optionally comprise at least one first left opening binding indent (114BLA) functioning to facilitate cracking of first ice (118) into separate cubes. The first right opening binding (114BR) may optionally comprise at least one first right opening binding indent (114BRA) functioning to facilitate cracking of first ice (118) into separate cubes.

The first ice making bag (110) may optionally further comprise at least one first central binding (114C). The at least one first central binding (114C) may be a first primary central binding (114C') which comprises a first primary central left binding (114C'L) and a first primary central right binding (114C'R) functioning to facilitate cracking of first ice (118) into separate cubes. The first primary central binding (114C') further comprises a first primary central top binding (114C'T) and a first primary central bottom binding (114C'B) functioning to facilitate cracking of first ice (118) into separate cubes. The at least one first central binding (114C) is a first primary central binding (114C') which comprises a first primary central top binding (114C'T) and first primary central bottom binding (114C'B) functioning to facilitate cracking of first ice (118) into separate cubes. The first primary central binding (114C') further comprises a first primary central left binding (114C'L) and a first primary central right binding (114C'R) functioning to facilitate cracking of first ice (118) into separate cubes. The first ice making bag (110) may optionally further comprise a first middle binding (114D) functioning to facilitate cracking of first ice (118) into separate cubes.

The first ice making bag (110) is manufactured from a material selected from a group consisting of plastic, plastic composites, rubber, rubber composites, metal and metal alloy. Plastic, plastic composites, rubber, and rubber composites are the preferred material of manufacture.

An user holds the first ice making bag (110) in a vertical position pouring liquid in through the gap into the pocket formed between the first envelope top (112T) and a first envelope bottom (112B) and placing the first ice making bag (110) in a freezer to form first ice (118). The air channel functions to facilitate release of air previously entrapped in the pocket during filing.

Figure 2:
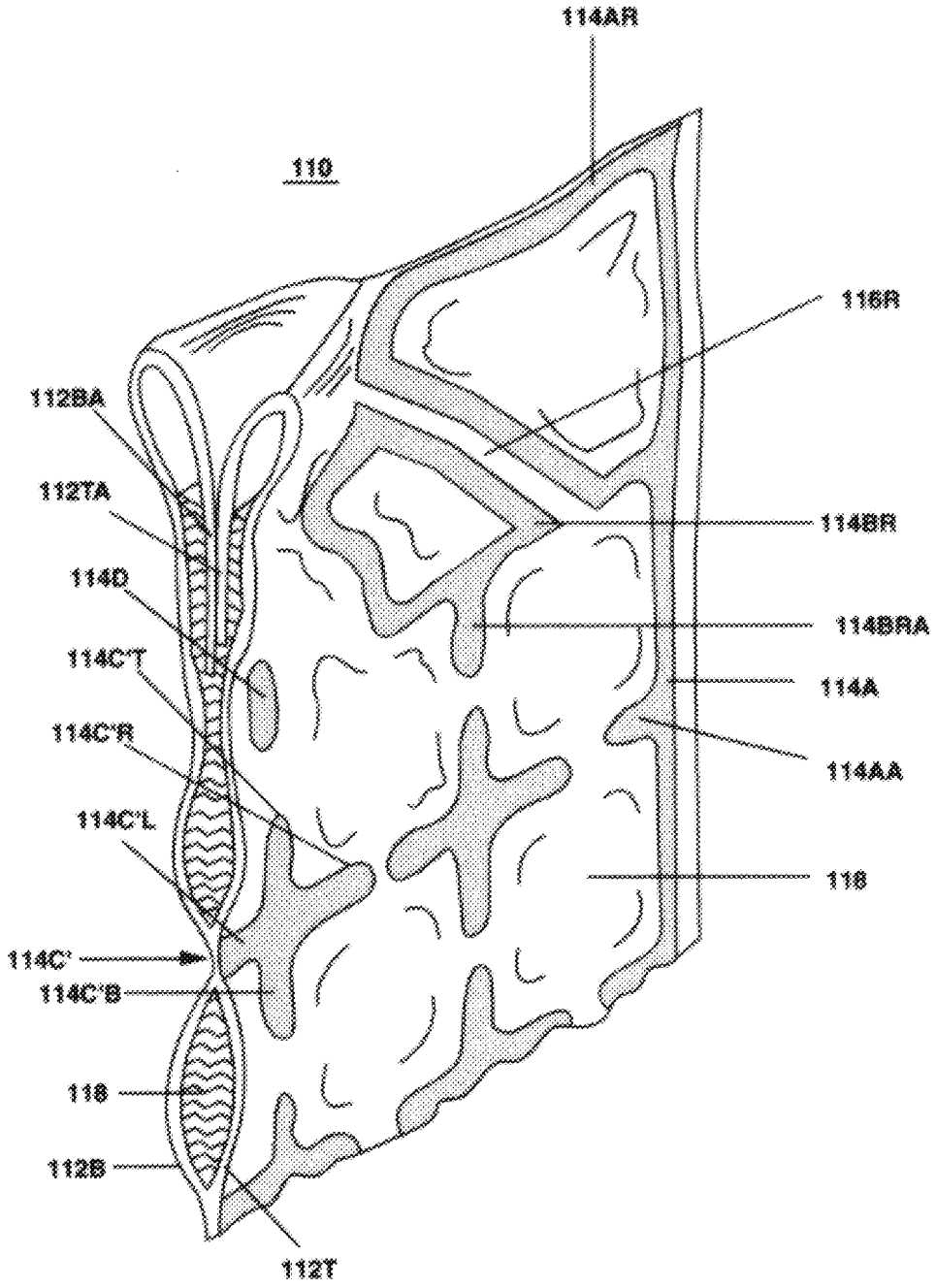
FIG. 2 is a partial cross sectional view of a first ice making bag (110) along line 2—2 of FIG. 1.

Referring to FIG. 2 which is a partial cross sectional view of a first ice making bag (110) along line 2—2 of FIG. 1. The first envelope top (112T) comprises a first envelope top lip (112TA) positioned inwardly thereof and the first envelope bottom (112B) comprises a first envelope bottom lip (112BA) positioned inwardly thereof. The first envelope top lip (112TA) and the first envelope bottom lip (112BA) function to form a seal therebetween resulting from back pressure when the pocket is filled with water and the first ice making bag (110) is placed on a horizontal surface. One of the first envelope lips (112TA, 112BA) is preferably longer than the other functioning to improve the seal therebetween resulting from back pressure when the pocket is filled with water and the first ice making bag (110) is placed on a horizontal surface.

It will be understood that each of the elements described above, or two or more together, may also find a useful application in other types of constructions differing from the type described above.

While the invention has been illustrated and described as embodied in a ice making bag, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. a first ice making bag (110) comprising:

a) a first envelope (112) which comprises a first envelope top (112T) and a first envelope bottom (112B);

B) a first binding (114) which comprises a first peripheral binding (114A), a first left peripheral opening binding (114AL), and a first right peripheral opening binding (114AR), the first left peripheral opening binding (114AL) and the first right peripheral opening binding (114AR) form a gap therebetween, the first binding (114) functions to form a pocket between the first envelope top (112T) and the first envelope bottom (112B); and C) at least one first opening binding (114B) forming an air channel between the first left peripheral opening binding (114AL) or the first right peripheral opening binding (114AR) and the at least one first opening binding (114B), an user holds the first ice making bag (110) in a vertical position pouring liquid in through the gap into the pocket formed between the first envelope top (112T) and a first envelope bottom (112B) and placing the first ice making bag (110) in a freezer to form first ice (118), the air channel functions to facilitate release of air previously entrapped in the pocket during filling.

2. The first ice making bag (110) as described in claim 1, wherein the first envelope top (112T) comprises a first envelope top lip (112TA) positioned inwardly thereof and the first envelope bottom (112B) comprises a first envelope bottom lip (112BA) positioned inwardly thereof, the first envelope top lip (112TA) and the first envelope bottom lip (112BA) function to form a seal therebetween resulting from back pressure when the pocket is filled with water and the first ice making bag (110) is placed on a horizontal surface.

3. The first ice making bag (110) as described in claim 2, wherein one of the first envelope lips (112TA, 112BA) is longer than the other which functions to improve the seal therebetween resulting from back pressure when the pocket is filled with water and the first ice making bag (110) is placed on a horizontal surface.

4. The first ice making bag (110) as described in claim 1, wherein the first peripheral binding (114A) comprises at least one first peripheral binding indent (114AA) functioning to facilitate cracking of the first ice (118) into separate cubes.

5. The first ice making bag (110) as described in claim 1, wherein the first opening binding (114B) comprises a first left opening binding (114BL) and a first right opening binding (114BR), the first left opening binding (114BL) and the first left peripheral opening binding (114AL) form a first left air channel (116L) therebetween, the first right opening binding (114BR) and the first right peripheral opening binding (114AR) form a first right air channel (116R) therebetween.

6. The first ice making bag (110) as described in claim 1, wherein the first left opening binding (114BL) comprises at least one first left opening binding indent (114BLA) functioning to facilitate cracking of first ice (118) into separate cubes.

7. The first ice making bag (110) as described in claim 1, wherein the first right opening binding (114BR) comprises at least one first right opening binding indent (114BRA) functioning to facilitate cracking of first ice (118) into separate cubes.

8. The first ice making bag (110) as described in claim 1 further comprises at least one first central binding (114C).

9. The first ice making bag (110) as described in claim 8, wherein the at least one first central binding (114C) is a first primary central binding (114C') which comprises a first primary central left binding (114C'L) and a first primary central right binding (114C'R) functioning to facilitate cracking of first ice (118) into separate cubes.

10. The first ice making bag (110) as described in claim 9, wherein The first primary central binding (114C') further comprises a first primary central top binding (114C'T) and a first primary central bottom binding (114C'B) functioning to facilitate cracking of first ice (118) into separate cubes.

11. The first ice making bag (110) as described in claim 8, wherein the at least one first central binding (114C) is a first primary central binding (114C') which comprises a first primary central top binding (114C'T) and first primary central bottom binding (114C'B) functioning to facilitate cracking of first ice (118) into separate cubes.

12. The first ice making bag (110) as described in claim 11, wherein the first primary central binding (114C') further comprises a first primary central left binding (114C'L) and a first primary central right binding (114C'R) functioning to facilitate cracking of first ice (118) into separate cubes.

13. The first ice making bag (110) as described in claim 1 further comprises a first middle binding (114D) functioning to facilitate cracking of first ice (118) into separate cubes.

14. The first ice making bag (110) as described in claim 1 is manufactured from a material selected from a group consisting of plastic, plastic composites, rubber, rubber composites, metal and metall alloy.

* * * * *